United States Patent [19]

Greenough

[11] Patent Number: 5,006,014

[45] Date of Patent: Apr. 9, 1991

[54] BOOM STICKS

[75] Inventor: Ronald L. Greenough, Surrey, Canada

[73] Assignee: MacMillan Bloedel Limited

[21] Appl. No.: 473,756

[22] Filed: Feb. 2, 1990

[51] Int. Cl.[5] ..... E02B 15/04

[52] U.S. Cl. ..... 405/72; 405/63; 405/60.5

[58] Field of Search ..... 114/270, 219, 292, 267, 114/266, 220; 441/35, 44–48; 405/63–72, 16, 21, 60.5, 60

[56] References Cited

U.S. PATENT DOCUMENTS 4,378,749 4/1983 Leblanc et al. ..... 114/219
4,406,241 9/1983 Comte ..... 114/220

FOREIGN PATENT DOCUMENTS 2532255 2/1977 Fed. Rep. of Germany ..... 405/63

*Primary Examiner*—Ed Swinehart

[57] ABSTRACT

A boom stick for use with log booms in water transport and storage of logs is formed by a plurality of vehicle tires (used) arranged in substantially axially aligned, side by side relationship with their tread surfaces forming the outer periphery of the boom stick. Axially extending reinforcing rods pass through the rim receiving holes in the tires and hold the tires together and a material (preferably foam concrete) having a higher specific gravity of less than 1 substantially fills the tires. In a preferred arrangement the tires are filled to a preselected level with light weight material and the remainder filled with a material having a higher specific gravity than the light weight material to provide a longitudinally extending heavy segment that orients the boom stick in the water.

10 Claims, 2 Drawing Sheets

BOOM STICKS

FIELD OF THE INVENTION

The present invention relates to boom sticks. More particularly the present invention relates to a fabricated boom stick formed from vehicle tires held in side by side relationship and filled with a material that causes the boom stick to float, and to give it structural rigidity.

BACKGROUND OF THE INVENTION

When shipping logs by water it is common practice to form booms wherein a plurality of logs are bound together and confined by boom sticks. Generally there will be a forward boom stick, a pair of side boom sticks and a rear boom stick comprising each log boom. Such boom sticks are usually selected logs having lengths of up to about 66 feet. It is commonly desired that they be capable, without submerging, of carrying a man as he walks along the surface of the boom stick. Commonly boom sticks average about 2 feet in diameter. It will be apparent that such a log contains a significant amount and value of wood. Due to marine bores, decay and mechanical noise, wooden sticks deteriorate and need frequent replacement.

Attempts have been made to provide artificial boom sticks from steel by forming an elongated steel drum of the required length and closing off the ends. Similar artificial boom sticks have been made from hollow concrete sections formed for example by spin casting in a manner similar to that used for forming hollow telephone poles. Obviously the ends of the concrete boom sticks are also capped and the concrete is made non-porous. Neither the steel nor the concrete boom stick have been fully accepted by the industry generally because such boom sticks do not have the characteristics of the wooden boom stick they are intended to replace. Generally artificial boom sticks have been relegated to use in defining the outer periphery of holding areas or corrals for logs and function as the equivalent of the corral fence or gate sections.

BRIEF DESCRIPTION OF THE PRESENT INVENTION

It is an object of the present invention to provide an artificial boom stick composed of a plurality of vehicle tires.

Broadly the present invention relates to a boom stick comprising a plurality of substantially axially aligned vehicle tires of essentially the same diameter arranged in side by side relationship having tread surfaces forming an outer peripheral surface of said boom stick, axially extending reinforcing means passing through rim receiving holes in said tires and holding said tires together in said side by side relationship and a first rigidly imparting filling material having a specific gravity less than one contained within said tires and substantially filling said rim receiving holes in said tires.

Preferably a second orienting filling material having a higher specific gravity than said first filling material will be used to complete the filling of said tires to define an axially extending segment of said boom stick and define a heavier side to said boom stick to orient said boom stick when in the water.

Preferably said reinforcing means will comprise a plurality of reinforcing rods extending substantially the full axial length of said boom stick and will be positioned adjacent to the beads of said tires defining the rim openings and equally spaced around said rim openings.

Preferably the proportions and densities of the first and second filling material will be regulated to give the stick an average overall specific gravity of 0.6 and thus result in said boom stick being submerged by about 60% when in water.

Preferably said first material will be lightweight concrete with a density less than 1 and said second material will be a concrete material having a density greater than the density of said first filling material.

The present invention also relates to a method of making a boom stick comprising threading a plurality of vehicle tires onto reinforcing rods so that said reinforcing rods extend axially in spaced relationship around the periphery of the rim openings of said tires and are hold said tires in sidewall to sidewall relationship, injecting lightweight concrete filling into said tires at spaced locations along the length of said boom stick to fill said tires to the desired depth with said concrete said concrete having a specific gravity of less than one, setting said concrete.

Preferably said lightweight concrete will be injected into said tires to fill same to a preselected level and then a denser concrete material will be injected into the remaining portion of the tires to fill the tires and provide a longitudinally extending segment of stick having a higher specific gravity.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENT

Figure 1:
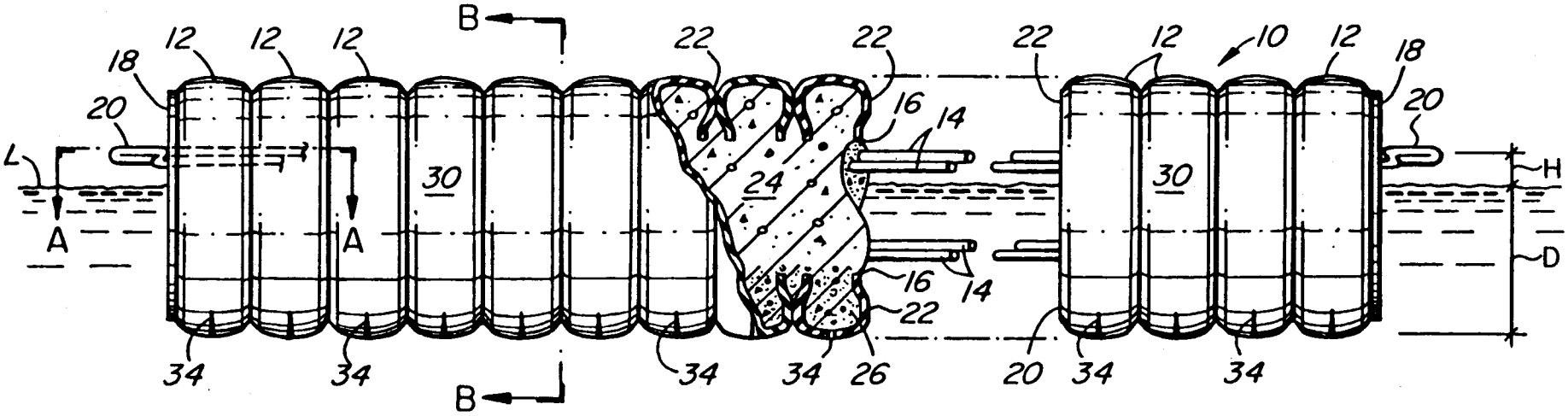
FIG. 1 is a side elevation partly in section illustrating boom stick constructed in accordance with the present invention.

As shown in FIG. 1 the boom stick 10 is composed of a plurality of vehicle tires 12 arranged in axially aligned side by side relationship. Reinforcing rods 14 (four shown in the illustration) extended longitudinally (axially) of the boom stick 10 through the rim openings 16 in each of the tires and are anchored or otherwise secured to end plates 18 (only one shown, see FIG. 2) at each axial end of the boom stick 10.

Preferably the reinforcing rods (at least two of them) will be interconnected and form a loop as shown at 20 at opposite ends of the boom stick 10 to provide a cable receiving eye for tying the booms together.

The tires are held in close side by side relationship with their side walls 22 in intimate abutting relationship with adjacent side walls of adjacent tires thereby to provide a substantially closed compartment extending substantially the full length of the boom stick and including the interior of the tires 10 and the space within the rim openings 16.

A suitable first filling material 24 having a specific gravity of less than one fills the space within the tires and the rim openings 16 to provide a boom stick that will float. This filling material also functions to aid in providing structural rigidity to the boom stick.

It is preferred that a longitudinally extending segment 28 (see FIG. 3) of the boom 10 be filled with a second material 26 having a higher specific gravity than the material indicated at 24. This longitudinally extending segment 28 which is heavier than the material 24 ensures that the segment 28 is submerged and forms the low side of the boom stick 10.

The tread surfaces 30 of each of the tires forms the outer periphery of the boom 10. Generally the tires 12 used to form a boom stick will have essentially the same outside (tread) diameter so that there are not too many bumps and ridges and to ensure that the logger can easily walk along the surface. In any event the system of manufacture directs discrepancies in diameters of ties toward the heavier or submerged side of the boom so that the side along which the logger will walk is generally relatively smooth, i.e. in the same plane as determined by the platform or floor on which the tires are supported during the manufacturing of the boom stick.

It will be apparent that the embodiment shown in FIG. 1 is relatively stable and that a logger can easily walk along the upper surface of the boom 10 since the surface is made of rubber and thus is easily gripped by the boot calks of the logger. Also the use of the axially extending heavier segment 28 stabilizes the boom in the position shown in FIG. 1 and ensures that the openings 20 are easily accessible to the logger for securing the boom stick to other boom sticks or the like.

Figure 3:
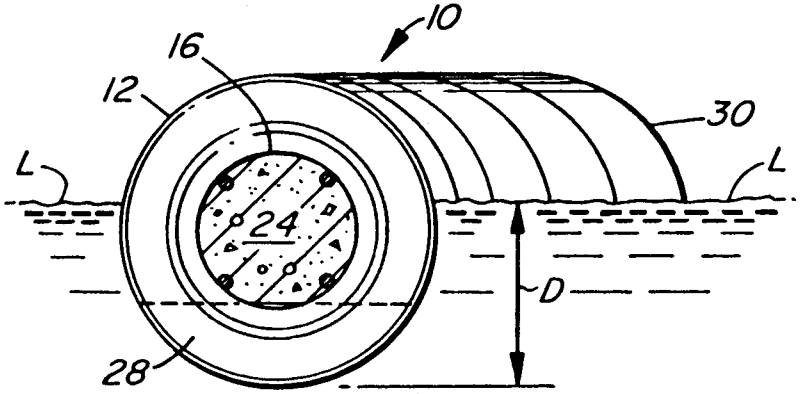
FIG. 3 is a section along the line B—B in FIG. 1 and illustrating a modified form of boom stick.

In the embodiment of FIG. 3, the boom stick has been shown to be slightly curved. By so curving the boom stick the stability is further enhanced in that it is very difficult to turn a curved boom stick on its axis when it is floating in the water. This system of curving the boom stick permits filling of the total of the interior of the boom stick 10 with essentially the same material, however it is preferred to have a heavier segment such as the segment 28 to further ensure proper orientation and provide a self-orienting substantially straight boom stick.

The density of the combined light material 24 and heavy material 26 preferably will be such that about 60% of the boom stick will be submerged, i.e. dimension D in FIGS. 1 and 3 will be approximately 60% of the total diameter of the boom stick 10 and the loop or hole 20 will be above the surface of the water L by a distance H which preferably at least about 1 inch.

Figure 2:
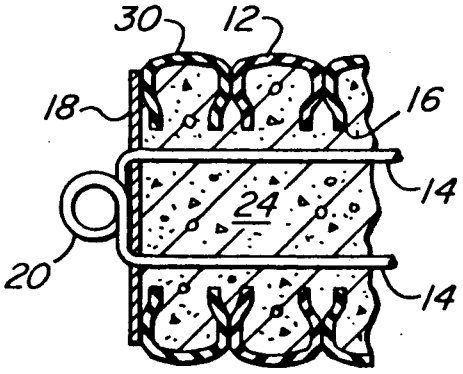
FIG. 2 is a section along the lines A—A in FIG. 1.
Figure 4:
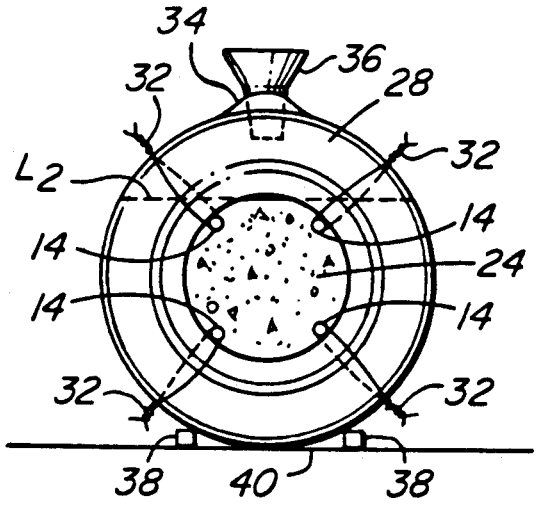
FIG. 4 is a cross section along the line B—B showing the boom stick in a stage of manufacture and FIG. 5 is a partial section illustrating the pouring of the heavier material into one of the tires to form a portion of a longitudinally extending heavier segment of the boom stick.

To manufacture the boom stick 10 a plurality of tires 12 arranged in side by side relationship as shown in FIG. 1 and the reinforcing rods 14 which are anchored or tied together at the end plates 18 are preferably secured to spaced tires by ties such as those indicated at 32 in FIG. 4. The tires 12 are split along their upper tread surface as indicated at 34 for a distance to permit insertion of a pouring funnel 36. The tires 12 may be held in the oriented position as illustrated in FIG. 2 by any suitable means such as the blocks 38. It will be noted that the bottoms of the tires are all in the same plane namely the plane of the floor or platform 40 on which they are supported. Due to the higher density used in the final filling the aligned side will be the top when the stick is floated.

Figure 5:
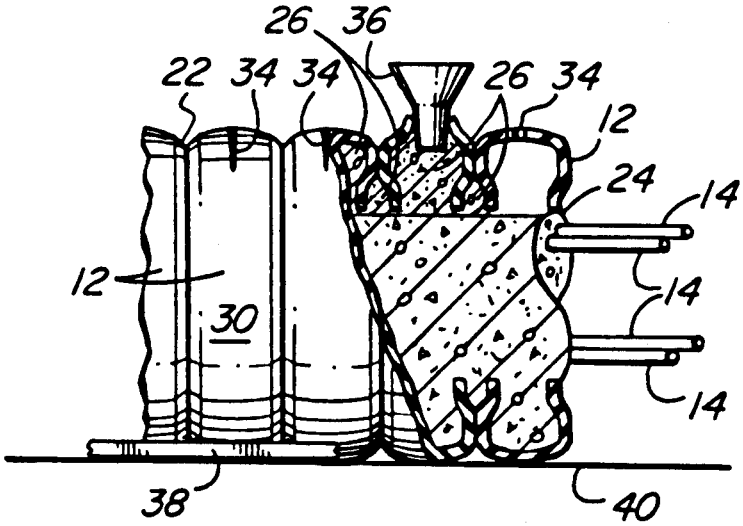

Suitable filling material 24 is poured into the tires through the funnel 36 inserted through the slit 34. It is not necessary when applying the filler 24 to fill through each of the tires to the required level as indicated at $L_2$ in FIG. 5 which defines the cord where the heavier segment 28 commences.

Obviously if a heavier segment 28 is not to be provided each of the tires will be substantially completely filled including the segment 28 with the filling material 24 but the specific gravity of the filling material 24 will then be slightly higher than the specific gravity of filling material 24 when the heavier segment 28 is to be used so that the boom stick will be about 60% submerged.

The filling material 24 will preferably be lightweight (low density) concrete having a specific gravity significantly less than 1. The filling material 26 forming the heavier segment 28 will also preferably be concrete but with a higher density (specific gravity) than the light weight concrete used as the first material 24. Concrete is preferred as the filling material as its density may be selected, it is easily poured into the tires and it imparts rigidity to the boom stick when it sets.

After the first filling material 24, preferably a lightweight concrete (specific gravity less than 1), has been filled to the desired level $L_2$ along substantially the full length of the boom stick 10, the process is repeated with each of the tires being filled from the level $L_2$ to substantially the top of the inside of each tire 12 with a second denser material 26 which may take the form of denser concrete (e.g. specific gravity greater than 1) to form the heavier segment 28 extending substantially the full length of the boom stick 10.

Obviously the heavier concrete 26 will only be injected into each of the tires after the lighter material 24 has set sufficiently to support the heavier material.

After the material 24 and 26 has set the boom stick is ready for use and the upper side formed by the segment 28 will form the low side when the boom stick is placed in the water.

If a curved boom stick is to be produced it is preferred to preform the tires into a slightly curved relationship and then fill them. However it is important that the side walls on the greater diameter side of the boom stick remain in contact to provide a seal and prevent escape of the injected material.

The term axial alignment of the tires is intended to include a slight curvature if this alternative is to be used to stabilize flotation orientation. It will be apparent that the filling material 24 must be such that it does not leak from the interior of the boom stick 10 or when the heavier segment 28 is provided that the materials 24 and 26 do not migrate significantly in the boom stick. For this reason a pourable, setable, stable material that sets in situ in the tires is preferred for filling the boom stick and binding the reinforcing rods and tires together.

Having described the invention, modifications will be evident to those skilled in the art without department from the spirit of the invention as defined in the appending claims.

I claim:

1. A boom stick comprising a plurality of substantially axially aligned vehicle tires of essentially the same diameter arranged in side by side relationship having tread surfaces forming an outer peripheral surface of said boom stick, axially extending reinforcing means passing through rim receiving holes in said tires and holding said tires together in said side by side relationship and a first rigidity imparting filling material having a specific gravity less than one contained within said tires and substantially filling said rim receiving holes in said tires, said rigidity imparting filling material cooperating with said reinforcing means.

2. A boom stick as defined in claim 1 further comprising a second filling material having a specific gravity greater than said first filling material, said second filling material filling a portion of each of said tires to define an axially extending segment of said boom stick to provide a heavier side to said boom stick, said heavier side orienting said boom stick when said boom stick is floating.

3. A boom stick as defined in claim 2 wherein said reinforcing means comprises reinforcing rods extending substantially the full axial length of said boom stick and positioned in said rim receiving holes adjacent to and spread around edges of said tires defining said rim receiving holes.

4. A boom stick as defined in claim 3 wherein said first material comprises a lightweight concrete and the specific gravity of said boom stick will result in said boom stick being submerged by 60% when in water.

5. A boom stick as defined in claim 2 wherein said first material comprises a lightweight concrete and the specific gravity of said boom stick will result in said boom stick being submerged by 60% when in water.

6. A boom stick as defined in claim 1 wherein said reinforcing means comprises reinforcing rods extending substantially the full axial length of said boom stick and positioned in said rim receiving holes adjacent to and spread around edges of said tires defining said rim receiving holes.

7. A boom stick as defined in claim 6 wherein said first material comprises a lightweight concrete and the specific gravity of said boom stick will result in said boom stick being submerged by 60% when in water.

8. A boom stick as defined in claim 1 wherein said first material comprises a lightweight concrete and the specific gravity of said boom stick will result in said boom stick being submerged by 60% when in water.

9. A method of making a boom stick comprising threading a plurality of vehicle tires onto reinforcing rods so that said reinforcing rods extend axially of said tires, positioning said rods in spaced relationship around the periphery of rim openings of said tires, holding said tires in sidewall to sidewall relationship, injecting lightweight foamed concrete into said tires at spaced locations along the length of said boom stick to fill said tires to a desired depth with said foamed concrete, said foamed concrete having a specific gravity of less than one and setting said foamed concrete.

10. A method as defined in claim 9 further comprising injecting a concrete material denser than said lightweight concrete into the remaining portion of the tires to fill the tires and provide a longitudinally extending segment of boom having a specific gravity greater than said lightweight concrete.

* * * * *